United States Patent [19]

Lieberman

[11] 4,294,503

[45] Oct. 13, 1981

[54] LOCKING MEANS FOR A LAMP HOLDER

[75] Inventor: Gilbert R. Lieberman, Hampstead, Canada

[73] Assignee: Gilbert Products, Pointe-aux-Trembles, Canada

[21] Appl. No.: 111,372

[22] Filed: Jan. 11, 1980

[30] Foreign Application Priority Data

Dec. 7, 1979 [CA] Canada ..... 341477

[51] Int. Cl.[3] ..... H01R 13/629

[52] U.S. Cl. ..... 339/119 L; 339/91 L

[58] Field of Search ..... 151/12, 25 R, 25 A, 151/19 A, 26, 30; 362/433, 414, 457; 285/39; 339/91 L, 119 L, 177 L, 182 L, 184 L, 185 RL; 403/320

[56] References Cited

U.S. PATENT DOCUMENTS 1,566,830 12/1925 Clark ..... 151/25 R
3,871,732 3/1975 Appleton ..... 339/91 L
4,081,668 3/1978 Mori ..... 362/457 X

FOREIGN PATENT DOCUMENTS 457578 3/1928 Fed. Rep. of Germany ... 339/119 L
889034 7/1953 Fed. Rep. of Germany ..... 362/457
13248 of 1909 United Kingdom ..... 151/25

*Primary Examiner*—Eugene F. Desmond
*Attorney, Agent, or Firm*—Browdy and Neimark

[57] ABSTRACT

Locking means for a lampholder having an opening to receive a threaded component. A locking member is captively carried by the lampholder and is mounted for limited movement in a direction normal to the axis of the opening, and the locking member has at least one inwardly facing edge for contact with a threaded component threadably inserted into the lampholder, the locking member permitting threaded insertion of the threaded component and preventing inadvertent threaded removal.

13 Claims, 9 Drawing Figures

LOCKING MEANS FOR A LAMP HOLDER

The present invention relates to means for automatically locking a lamp holder onto a threaded component to prevent inadvertent removal of the lamp holder therefrom.

In this specification, the terminology "lamp holder" (also referred to as a lamp socket or light socket) is used to describe the well known device for receiving and holding a light bulb and which device conventionally consists of a body portion and a cap portion and internal wiring for conducting electric current to the light bulb. These lamp holders are used in association with threaded components usually in the form of threaded nipples or threaded pipes to provide for proper mounting with the cap having an axially threaded opening to receive the threaded component. Electrical Safety Codes throughout the world require that locking means for securing the lamp holder to the threaded component be provided to guard against inadvertent removal of the lamp holder. This requirement is well justified for disassembly of these component parts may expose the electrical wires, and any unskilled disassembly or inadvertent disassembly such as by a child can result in electric shocks which can be harmful or even fatal.

DESCRIPTION OF PRIOR TECHNIQUES

Conventionally, a lamp holder is secured to a threaded support by a set screw carried by the cap portion of the lamp holder. In assembly, the screw is loosened and the support threaded into proper positioning within the cap and then the screw is tightened against the threaded support to provide for positive securement. When properly assembled, this prior art technique functions very satisfactorily. However, proper assembly and securement requires concentration by a worker and in assembly line production of lamps and other lighting fixtures it frequently occurs that the threaded supports are not properly threaded within the cap, and the set screw not properly tightened. In mass production a worker is provided with a supply of lamp holders which have their set screws already in place, these screws usually having been previously positioned by mechanized equipment and tightened into relationship with their cap to prevent loss. The worker must then by using a screw driver withdraw the set screw a distance to permit entry of the threaded component and must then retighten the screw against the component to provide for positive securement. In many of these lamp holders it is difficult to loosen the screw because of the force with which it is threaded into the cap, and this is sometimes impossible without stripping the threads of the screw or deforming the slot in the screw head, requiring the use of a new cap and/or screw. Even with proper manufacture of lamp holder components, the locking screws are often dropped during assembly of the lighting appliance, and the insertion and tightening of a replacement screw slows productivity.

It also happens during assembly line production or otherwise that the threaded component is not threaded into the lamp holder a sufficient distance to enable the set screw to firmly tighten onto the component and in such cases the assembly is dangerous for the holder can then be quite readily and inadvertently removed from the component exposing a person to possible danger.

DESCRIPTION OF THE PRESENT INVENTION

The present invention avoids the difficulties present in the prior art structures by providing locking means for a lamp holder which enables simplified threaded insertion of the component into the cap but which acts to prevent inadvertent withdrawal.

The invention provides locking means for a lamp holder which has a threaded opening to receive a threaded nipple or pipe, the locking means being captively carried by the holder and which is mounted for limited movement in a direction normal to the axis of the threaded opening. The locking member has opposed inwardly facing edges for contact with the nipple or pipe upon insertion thereof into the lamp holder; the locking member permitting threaded insertion of the nipple or pipe but acting to prevent inadvertent threaded removal.

In the assembly of the invention the locking member is captively carried by the lamp holder but is so mounted that limited movement of the locking member with respect to the axis of the threaded opening is possible. This is done either by positioning the locking member within a cavity in the holder, or alternatively, by securing the locking member to the holder by a pin. In the embodiment where the locking member is carried in a cavity, a closing cap or cover is provided to hold the locking member captive in the lamp holder.

In one preferred embodiment, the locking member is of flat generally C-shaped configuration, having opposed inwardly facing edges with at least one portion of one inwardly facing edge having a serrated configuration, the teeth of the serrations being inclined in the direction of rotation of the nipple during threaded insertion into the cap.

A further feature of the invention is that the lamp holder is provided with an internal abutment which limits the extent to which the nipple or pipe can be threadedly inserted thereinto.

A further feature of the invention includes the provision of a bushing with the threaded opening being provided in the bushing and the locking member being carried by the bushing.

In a further embodiment, the locking member has a C-shaped configuration as discussed above, and the locking member has an inwardly facing edge for contact with the threaded nipple, at least a portion of the contact edge being serrated and the locking member being rotatably secured to the holder by a pin.

In accordance with one embodiment, the locking member has an opening of a size to at least partially receive the threaded component, with at least a portion of opposed inwardly facing edges of the opening being spaced apart a distance slightly less than the outer diameter of the component to be threaded into the threaded opening.

OBJECTS OF THE INVENTION

An object of the present invention is to provide a lamp holder having a threaded opening for reception of a threaded component means being carried by the holder for locking a threadedly inserted component against rotation relative to the holder in direction to prevent removal of the nipple, the locking means comprising a movable locking member captively carried by the holder, the member at least partially encircling the nipple or rod upon insertion thereof, and having at least one inwardly facing edge for locking contact with a threadedly inserted component to prevent rotation of the nipple in a relative direction to threadedly remove the nipple from a holder.

BRIEF DESCRIPTION OF ACCOMPANYING DRAWINGS

The inventive concept will now be more fully described with reference to the accompanying drawings wherein.

DETAILED DESCRIPTION OF ACCOMPANYING DRAWINGS

Figure 1:
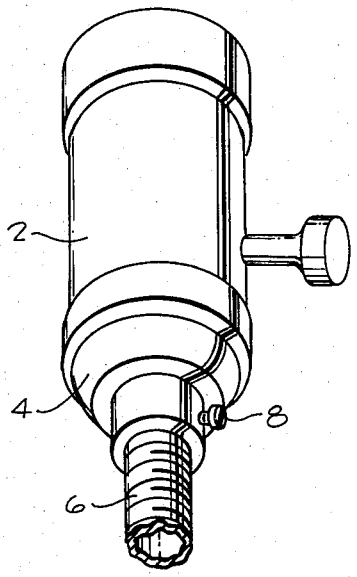
Fig 1 PRIOR ART
FIG. 1 illustrates in perspective view a lamp holder showing locking means commonly in use.

FIG. 1 illustrates a commonly used lamp holder as consisting of a body 2 and cap 4. A threaded nipple or pipe 6 is shown in FIG. 1 as being threadedly engaged in an axial threaded opening provided in the cap 4. After threaded insertion of the pipe, a locking or set screw 8 is simply tightened to positively lock the pipe and cap portions together. Prior art structure such as shown in FIG. 1 are usually of suitable metal material such as brass or the like and the body and cap are secured together in press-fit relationship.

Figure 2:
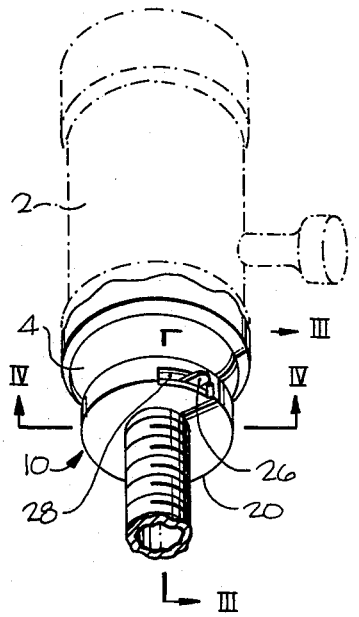
FIG. 2 illustrates one embodiment of the present inventive concept in perspective view.

One embodiment of the present inventive concept is illustrated in perspective view in FIG. 2. FIG. 2 shows a body portion 2 having an associated cap 4 and numeral 10 generally indicates the present locking arrangement in external view. This locking arrangement is more specifically shown in FIGS. 3 and 4 which are sectional views taken along correspondingly numbered lines as shown in FIG. 2.

Figure 3:
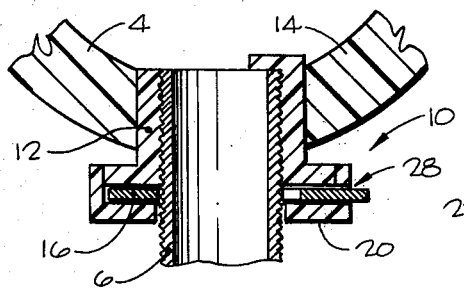
FIG. 3 is a side sectional view taken generally along lines III—III of FIG. 2.

FIG. 3 shows a bushing insert 12 securely fixed within cap 4. The bushing 12 has an axially threaded opening to threadedly receive threaded pipe 6, and the bushing may be provided with an abutment 14 formed integrally therewith to limit the depth to which the pipe can be threadedly inserted. In preferred construction, at least the external components of applicant's lamp holder are molded of suitable plastic material such as phenolic resins, the body and cap being preferably secured together by threading fit. The plastic material used in the molding of the body 2 and cap 4 may for reasons of economy of manufacture not be of a formulation adapted to provide sufficiently strong threading for the axial opening and this is the reason for the use of bushing 12. The bushing 12 may be of metal but preferably is of plastic material which will provide for secure threading. The bushing 12 regardless of the material from which it is made is secured in the cap 4 by any suitable means such as adhesive and/or snap-lock fit. The presence of bushing 12 is not, however, absolutely necessary and the cap could be fabricated completely of metal or completely of plastic and in the latter case the plastic material used would be of such a formulation to provide secure threading to receive pipe 6. In a cap molded completely of plastic suitable abutment means similar to abutment 14 can be provided.

Figure 4:
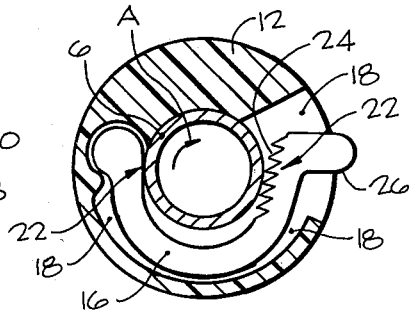
FIG. 4 is a sectional view taken generally along line IV—IV of FIG. 2.

FIG. 4 shows a locking member 16 positioned for limited movement within a cavity or recess 18 provided in the outer end of bushing 12. In the embodiment as shown in FIGS. 3 and 4, the locking member 16 is loosely positioned and is held captive in the recess 18 by the use of a retaining cap 20 (FIG. 3).

As shown in FIG. 3, the retaining cap may simply friction-fit over the bushing 12 and it may be adhesively-secured thereto, or alternatively, the retaining cap may simply snap into position on the cap enabling removal if necessary.

The locking member 16 as shown in FIG. 4 is of generally C-shaped configuration providing opposed inwardly facing contact edge surfaces 22 with at least one of the edge surfaces having a serrated or saw-tooth configuration, having teeth 24 inclining in the direction of clockwise rotation of the pipe (see arrow A in FIG. 4) during threaded insertion into the cap. The distance between at least portions of the opposed contact edge surfaces 22 is somewhat less than the outer diameter of the threaded pipe whereby a firm gripping and locking of the pipe can be achieved.

Because the locking member 16 is mounted for limited movement and because the teeth 24 are inclined in the direction of rotation of the pipe 6 during threaded insertion it will be appreciated that the pipe 6 can be threaded into the cap without any interference from the locking member. However, the teeth on the locking member will contact the pipe during any counter-rotation and this tooth contact will tend to rotate the locking member in counter-rotation direction to cause the edge surface 22 opposed to teeth 24 to wedge against the pipe with the result that the pipe becomes securely wedged between the opposed contacting surfaces.

In order to remove the locking member from wedging and locking contact with the pipe 6 the member may be provided with a tab 26 extending outwardly through a slot 28 provided in the retaining cap. In order to remove the member 16 from contact with pipe 6 it is necessary simply to move tab 26 a slight amount in counterclockwise direction as viewed in FIG. 4. By so doing, the pipe 6 can then be threadedly removed from the cap.

The "floating" mounting of the locking member as shown in FIGS. 3 and 4 is preferred. However, the locking member 16 could be secured to the holder by a pin 30 as shown in FIGS. 5A through 5E which show various possible configurations of the locking member. The locking members in these latter embodiments are rotatably carried by the pins 30 and in such an arrangement a retention cap would be required for aesthetic appearance only.

Figure 5A:
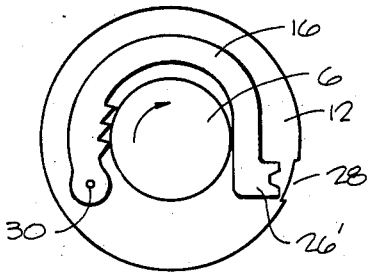
FIGS. 5A through 5E are schematic illustrations of various forms of locking members which can successfully be used in accordance with the present teachings to satisfy the objects of the present inventive concept.
Figure 5B:
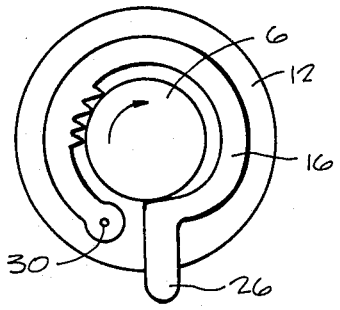
Figure 5C:
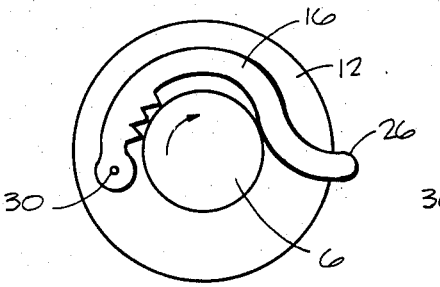
Figure 5D:
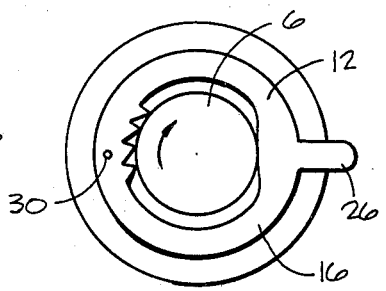
Figure 5E:
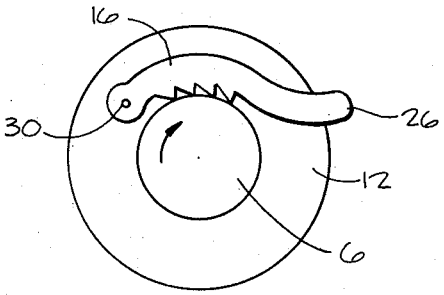

The tab 26' as shown in FIG. 5A does not project outwardly of the lamp holder. However, a slot 28 enables access to the locking member by using a suitable pointed tool and this arrangement guards against any inadvertent moving of the locking member.

I claim:

1. A locking arrangement for a lamp holder which has a threaded opening to receive a threaded component and having an axis, the locking device comprising:

a locking member captively carried by the lamp holder and which is mounted for limited movement in a direction normal to the axis of the threaded opening, the locking member having opposed inwardly facing edges for contact with a threaded component into the lamp holder, the lamp holder comprising a body portion and a cap portion, the locking member being positioned in a cavity provided in the cap portion and held captively therein by a retaining cap, and the locking member permitting threaded insertion of the threaded component and preventing inadvertent threaded removal.

2. Locking means according to claim 1, wherein the locking member is of flat generally C-shaped configuration, at least one portion of one inwardly facing edge having a serrated configuration, points of the serrations being inclined in the direction of rotation of the component during threaded insertion into the holder.

3. A locking arrangement according to claim 1, wherein the locking member is secured to the cap by a pin about which the locking member has limited rotation.

4. A locking arrangement according to claim 1, wherein the lamp holder has an internal abutment limiting the extent to which the component can be threadedly inserted.

5. A locking arrangement according to claim 1, wherein the cap includes a bushing, the threaded opening for receiving the component being provided in the bushing and the locking member being positioned in a cavity provided in the bushing.

6. A locking arrangement according to claim 1, wherein the distance between at least portions of the opposed edges being slightly less than the outer diameter of the threaded component.

7. Locking means according to claim 1, wherein the locking member has an opening of a size to at least partially receive the threaded component, at least a portion of opposed inwardly facing edges of the opening being spaced apart a distance slightly less than the outer diameter of the threaded component.

8. A locking arrangement according to claim 1, the locking member having a tab projecting externally of the cap, the tab enabling manual movement of the locking member to remove the edge surfaces from contact with the component to enable removal of the component from the holder.

9. Locking means according to claim 8, wherein the tab projects outwardly through a slot provided in a side wall of the retaining cap.

10. A lamp holder having a threaded opening for reception of a threaded component, and locking means carried by the holder for securing a threadedly inserted component against rotation relative to the holder in direction to prevent removal of the component, the locking means comprising a movable locking member captively carried by the holder, the locking member at least partially encircling a component upon insertion thereof and having at least one inwardly facing edge for locking contact with the component to prevent rotation of the component in a direction to threadedly remove it from the holder, the lamp holder having a body portion and a cap portion threadedly secured together, the cap portion having a bushing fixedly secured therein and the threaded opening being provided in the bushing, a retaining cap covering the end of the bushing and the locking member being captively positioned in a cavity formed between the retaining cap and the bushing, the locking member having a tab projecting outwardly through a slot provided in the retaining cap.

11. A lamp holder according to claim 10, the locking member being captively secured to the cap by a pin.

12. A lamp holder according to claim 10, wherein the lamp holder has an internal abutment limiting the extent to which the component can be threadedly inserted.

13. A lamp according to claim 12, wherein the internal abutment is provided on the bushing.

* * * * *